US012601129B2

(12) United States Patent
Mulder

(10) Patent No.: US 12,601,129 B2
(45) Date of Patent: Apr. 14, 2026

(54) SNOWPLOW BLADE EDGE SHOE AND METHODS OF USE

(71) Applicant: Ryan Mulder, Channing, MI (US)

(72) Inventor: Ryan Mulder, Channing, MI (US)

( * ) Notice: Subject to any disclaimer, the term of this patent is extended or adjusted under 35 U.S.C. 154(b) by 371 days.

(21) Appl. No.: 18/242,896

(22) Filed: Sep. 6, 2023

(65) Prior Publication Data

US 2024/0352692 A1 Oct. 24, 2024

Related U.S. Application Data

(60) Provisional application No. 63/458,111, filed on Apr. 8, 2023, provisional application No. 63/454,071, filed on Mar. 23, 2023.

(51) Int. Cl.
*E01H 5/06* (2006.01)

(52) U.S. Cl.
CPC ..... *E01H 5/066* (2013.01)

(58) Field of Classification Search
CPC ..... E01H 5/066; E01H 5/067
USPC ..... 37/270, 272, 269
See application file for complete search history.

(56) References Cited

U.S. PATENT DOCUMENTS 2,498,470 A * 2/1950 Wenner ..... E01H 5/02 294/59
2,593,025 A * 4/1952 Hanson ..... E01H 5/066 280/28
2,611,979 A * 9/1952 Weller ..... E01H 5/066 37/270
2,722,064 A * 11/1955 Jaffe ..... E01H 5/06 37/231
3,845,577 A * 11/1974 Naymik ..... E01H 5/067 37/231
4,944,104 A * 7/1990 Kowalczyk ..... E01H 5/06 37/231
5,775,012 A * 7/1998 Hockensmith ..... E01H 5/06 37/270
6,240,662 B1 * 6/2001 Borowiak ..... E01H 5/061 37/270
8,607,481 B1 * 12/2013 Lukasko ..... E01H 5/066 37/270
9,551,122 B1 * 1/2017 Klein ..... B60K 11/08
D799,554 S * 10/2017 Peterson ..... D15/11
10,113,282 B2 * 10/2018 Behan ..... E01H 5/061
2005/0178029 A1 * 8/2005 Wightman ..... E01H 5/066 37/232

(Continued)

*Primary Examiner* — Jamie L McGowan
(74) *Attorney, Agent, or Firm* — Device Patent LLC

(57) ABSTRACT

A snow plow blade edge shoe comprising an elongate flattened C-channel profile. The snow plow blade edge show comprises a channel window opening to a blade cavity configured for seating a cutting edge of a snow plow assembly therein. In some embodiments, the edge shoe is secured by fasteners to the snow plow assembly. In other embodiments, the edge shoe is mounted using a quick release assembly. In some embodiments, the edge shoe is full length for use on a full blade, and in others is half-length for use on a left blade and right blade snow plow. When the snow plow assembly is lowered, an outer flat on the flattened C-channel is substantially parallel to the ground surface producing superior wear characteristics. Some embodiments include an additional wear plate secured to the outer flat and outer face of the flattened C-channel.

20 Claims, 7 Drawing Sheets

(56) References Cited

U.S. PATENT DOCUMENTS

| | | | | |
|---|---|---|---|---|
| 2006/0288617 | A1* | 12/2006 | Colclough | E01H 5/066 37/264 |
| 2012/0117831 | A1* | 5/2012 | Lathrop | E01H 5/066 37/270 |
| 2013/0145658 | A1* | 6/2013 | Tordik | E01H 5/061 37/270 |
| 2015/0135559 | A1* | 5/2015 | Tordik | E01H 5/061 37/270 |
| 2015/0135561 | A1* | 5/2015 | Henning | E01H 5/066 37/448 |
| 2017/0298583 | A1* | 10/2017 | Budrow | E01H 5/061 |
| 2023/0295889 | A1* | 9/2023 | Hunter | E01H 5/06 37/266 |
| 2024/0352692 | A1* | 10/2024 | Mulder | E01H 5/061 |

* cited by examiner

SNOWPLOW BLADE EDGE SHOE AND METHODS OF USE

CROSS REFERENCE TO RELATED APPLICATIONS

This application claims priority to Provisional Patent Application No. 63/458,111 filed Apr. 8, 2023, and Provisional Patent Application No. 63/454,071 filed Mar. 23, 2023 the entire disclosures of which are hereby incorporated by reference and relied upon.

BACKGROUND OF THE INVENTION

Field of the Invention. The invention relates generally to snowplows, and more particularly to devices to prevent damage to lawns and grass when snowplowing.

Description of Related Art. In the prior art are rounded elongate devices that cover a snowplow blade edge. These devices have a history of wearing out quickly as they are dragged along the pavement. When worn, the devices must be replaced with new which tends to be a tedious task because fasteners holding these devices may be corroded from the salty roads and thus hard to remove, and they are positioned low on the snow blade, and therefore ergonomically difficult to reach. In most cases, the work to replace these devices is typically done when conditions are slushy and cold. What is needed are devices that cover a snowplow blade edge and due to novel aspects of their design, have a much longer wear life. A longer life for these devices equates to not having to change the devices several times per year.

SUMMARY OF THE INVENTION

Disclosed herein is a novel snowplow blade edge shoe and methods of use. The edge shoe comprises a unique profile shape that significantly increases the wear life of the device and consequently reduces the cost of materials and labor related to changing snowplow blade edge shoes.

In one form, a snowplow assembly comprises a full blade that is approximately the width of a snowplow vehicle to which it is attached.

In one form, a snowplow assembly comprises a left blade and a right blade which together side by side are approximately the width of a snowplow vehicle to which it is attached.

In one form, a snowplow assembly is secured to the front of a snowplow vehicle such as a truck.

In one form, a snowplow assembly comprises a cutting edge which extends down from the snowplow blade and commonly scrapes across the road or driveway surface during plowing.

In one form, a snowplow assembly comprises mount holes extending through a snowplow blade configured to receive a fixation fastener and fixation nut for securing accessories to the snowplow assembly.

In one form, a snowplow blade edge shoe is a snowplow accessory configured for attachment to a snowplow assembly.

In one form, a snowplow blade edge shoe is a full-length snowplow edge shoe for use on a full-length plow.

In one form, a snowplow blade edge shoe is a half-length snowplow edge shoe for use on a half-length plow.

In one form, a snowplow blade edge shoe comprises an elongate flattened C-channel profile.

In one form, the flattened C-channel has an inner face defining an elongate inside of the C-channel.

In one form, the flattened C-channel has an inner flat defining an elongate flat portion of the inside of the C-channel.

In one form, the flattened C-channel has an outer face defining an elongate portion of the outside of the C-channel.

In one form, the flattened C-channel has an outer flat defining an elongate flat portion of the outside of the C-channel.

In one form, the flattened C-channel comprises a channel window that serves as an elongate opening into the flattened C-channel.

In one form, the flattened C-channel comprises a first window face at the channel window that spans between the outer face and inner face.

In one form, the flattened C-channel comprises a second window face at the channel window that spans between the outer face and inner face opposite the first window face.

In one form, the flattened C-channel comprises opposing end faces facing outward from opposing ends of the flattened C-channel. Each opposing end face joins the inner face and inner flat to the outer face.

In one form, extending from the flattened C-channel is a plurality of tabs for removably fixing the snowplow blade edge shoe to a snowplow assembly.

In one form, the plurality of tabs comprises a first tab, a second tab, and in some embodiments a third tab or n-th tab.

In one form, the first tab, second tab, and third tab are spaced along the C-channel.

In one form, the snowplow blade edge shoe is in an operable mode when the snowplow blade edge shoe is secured to the snowplow assembly and the outer flat face of the snowplow blade edge shoe is generally parallel to the ground when the snowplow is lowered to the ground.

In one form, in an operable mode, the tab has a forward face facing forward, a rearward face facing rearward, a superior face facing superior, a first lateral face facing lateral, a second lateral face facing an opposed lateral direction, and in some embodiments an inferior face facing inferiorly.

In one form, a fixation window extends between the forward face and the rearward face in the tab yet is inset from the superior face, lateral faces and inferior face (if present).

In one form, the fixation window is in the form of an elongate slot with its long dimension extending superior to inferior in an operable mode.

In one form, the fixation window is defined by a window surface extending between the forward faces and rearwards faces of the tabs.

In one form, the fixation window has a narrow diameter sufficient to pass the shank of a fixation fastener.

In one form, a fixation fastener is extended through the fixation window and mount holes and secured with a fixation nut to secure the snowplow blade edge shoe to the snowplow assembly.

In one form, a first bend line and a second bend line define the transition between the flat and curved sections of the flattened C-channel.

In one form, welds are utilized to secure the tabs to the flattened C-channel.

In one form, the tabs are contiguous sheet metal with the flattened C-channel.

In one form, the forward face of a tab is placed against the first window face of the flattened C-channel and welded into place.

In one form, the inferior face of a tab is placed against an outer face of the flattened C-channel adjacent to the first window face of the flattened C-channel and welded into place.

In one form, in an operable mode, a cutting edge comprises a lead cut face which faces forward, posterior cut face facing rearward, and an inferior cut face facing downward.

In one form, in an operable mode, a portion of the cutting edge of a snowplow assembly extends through the channel window and is seated within the elongate C-channel of the of the snowplow blade edge shoe.

In one form, in an operable mode, the cutting edge of a snowplow assembly abuts one or the other of: the inner face, and the inner flat.

In one form, in an operable mode, the tabs are fixed to the flattened C-channel at an angle $\alpha$ whereby when the snowplow is lowered to the ground, the outer flat is generally parallel to the ground.

In one form, a full-length plow is fitted with two half-length snowplow blade edge shoes fixed adjacent to each other to cover the full length of the plow cutting edge.

In one form, a snowplow blade edge shoe is equipped with a quick release mechanism wherein the snowplow blade edge shoe can quickly be mounted or dismounted without the hassle of threaded fasteners.

In one form, the quick release mechanism utilizes a releasable cotter pin extending through a block pin that in turn extends through a lock post that extends upwards from the flattened C-channel.

In one form, at least a portion of the outer flat and the outer face of a flattened C-channel is covered with a shortened wear plate covering just the end portions of the flattened C-channel or full length wear plate which covers substantially the entire length of the flattened C-channel.

In one form, the shorted wear plate and full length wear plates are welded to the flattened C-channel.

BRIEF DESCRIPTION OF THE SEVERAL VIEWS OF THE DRAWINGS

These and other features and advantages of the present invention will become more readily appreciated when considered in connection with the following detailed description and appended drawings, wherein each drawing is according to one or more embodiments shown and described herein, and wherein.

DETAILED DESCRIPTION OF SELECTED EMBODIMENTS OF THE INVENTION

Select embodiments of the invention will now be described with reference to the Figures. Like numerals indicate like or corresponding elements throughout the several views and wherein various embodiments are separated by letters (i.e. 100A, 100B, 100C). The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein.

Disclosed herein is a novel snowplow blade edge shoe and methods of use. The snowplow blade edge shoe comprises a novel profile that significantly increases the wear life of the shoe and consequently reduces the cost of materials and labor related to changing worn snowplow blade edge shoes.

Figure 1:
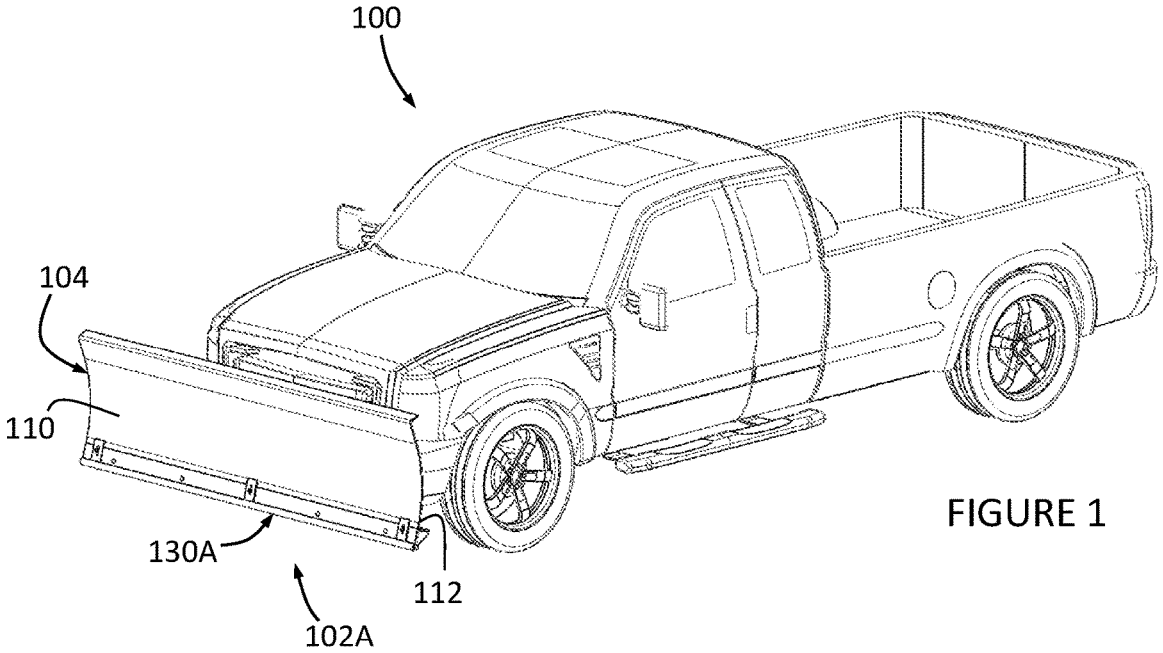
FIG. 1 depicts a perspective view of a vehicle with a full length snow plow assembly with a full length snow plow blade edge shoe covering a portion of a cutting edge.
Figure 2:
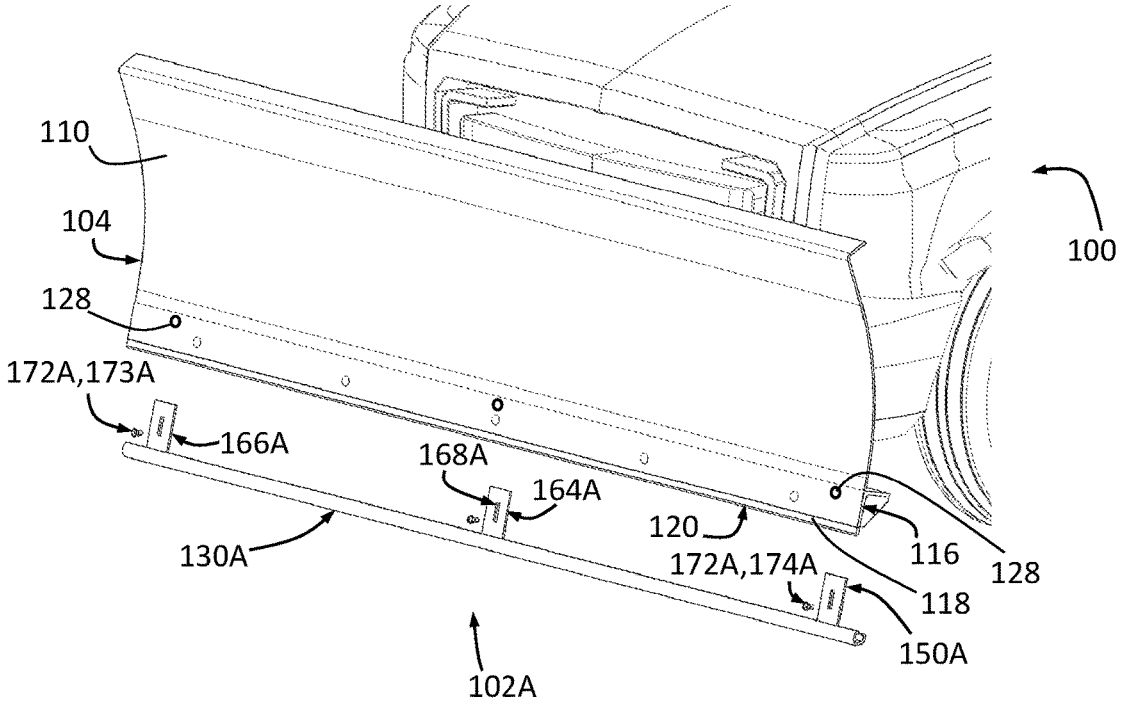
FIG. 2 depicts a partially exploded perspective view of the snow plow assembly with snow plow blade edge shoe of FIG. 1.
Figure 3:
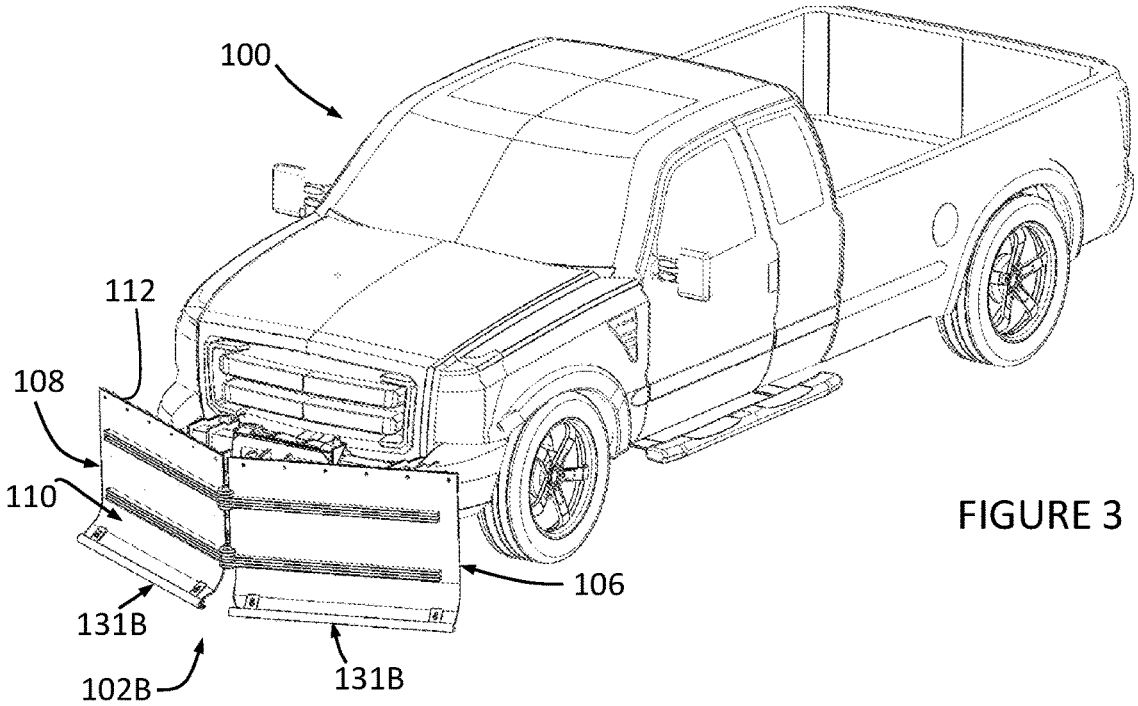
FIG. 3 depicts a perspective view of a vehicle with a half length snow plow assembly with a pair of half length snow plow blade edge shoes covering the cutting edge.
Figure 4:
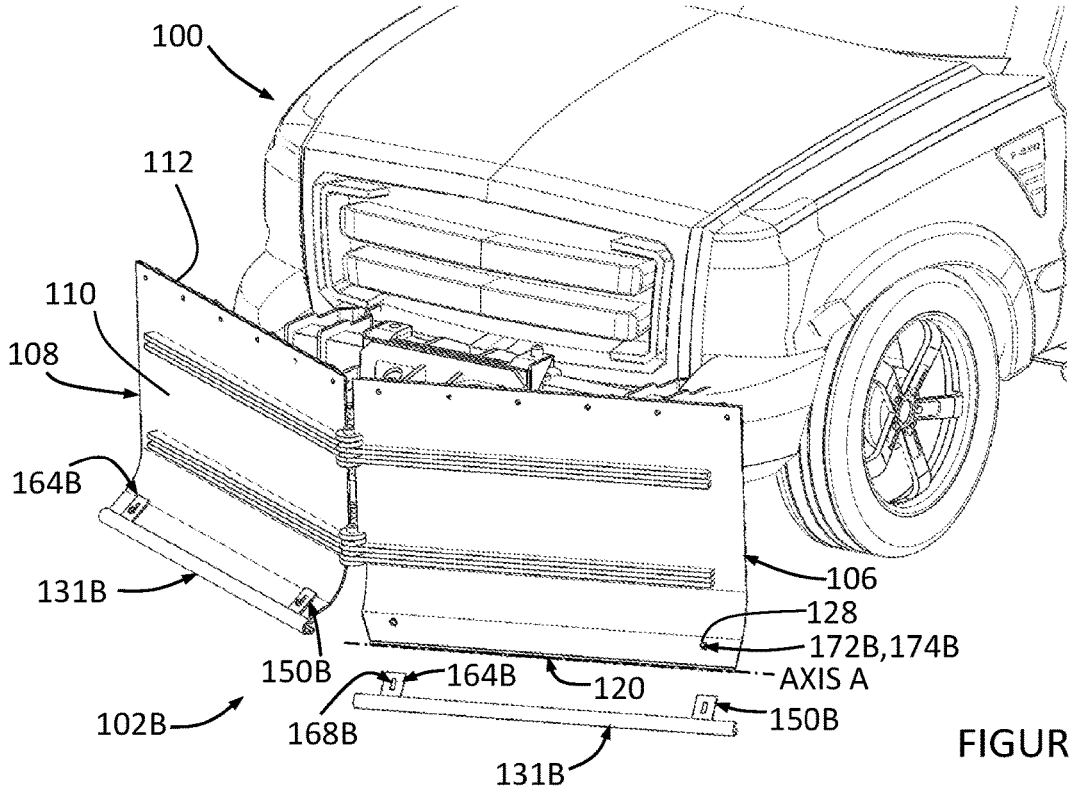
FIG. 4 depicts a partially exploded perspective view of the snow plow assembly with snow plow blade edge shoe of FIG. 3.

FIGS. 1 and 2 depict one embodiment of a snowplow vehicle 100 with a snowplow assembly 102A mounted to the front of the vehicle. In this embodiment, the snowplow assembly 102A comprises a full blade 104 that is approximately the width of the snowplow vehicle to which it is attached. FIGS. 3-4 depicts a snowplow assembly comprising two half-length blades (as used on V-plows) designated here as a left blade 106 and a right blade 108 which together side by side are approximately the width of the snowplow vehicle to which it is attached. As illustrated in FIGS. 1-4, the snowplow assemblies are secured to the front of a snowplow vehicle such as a truck.

Figure 14:
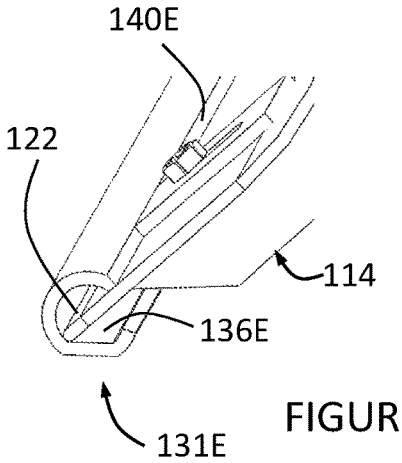
FIG. 14 depicts a partial top perspective view of a snow plow blade edge shoe mounted on a snow plow assembly.
Figure 15:
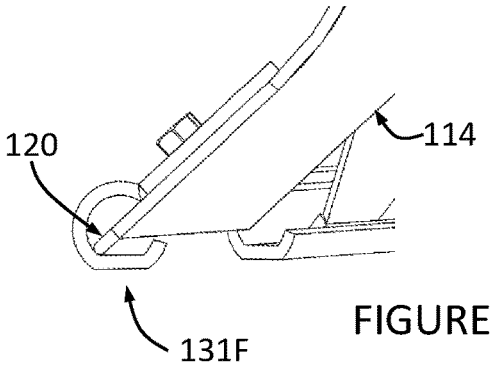
FIG. 15 depicts an end view of a pair of snow plow blade edge shoes mounted on a snow plow assembly.

In these and other embodiments, the snowplow assembly comprises a cutting edge 120. In addition, the snowplow assembly (i.e. 102A, 102B) comprises mount holes 128 extending through the respective snowplow blade (i.e. full blade, left blade, right blade) or other structures (i.e. base angle 116) on the snowplow assembly. The mount holes are configured to receive a fixation fastener (172A, 172B) and locked with a fixation nut (174A, 174B) for securing accessories to the snowplow assembly. As noted in FIGS. 1-4, commonly the full-blades and half-blades have a lead face 110 that is the face that pushes the snow when plowing. Opposite the lead face is a trail face 112. A plurality of blade ribs 114 (FIG. 14-15) are commonly present against the trail face 112 to reinforce the snowplow assembly. Some snowplow assemblies utilize a base angle 116 to reinforce the inferior portion of the snowplow blade. In some cases, the base angle is mounted below the blade ribs.

Figure 18:
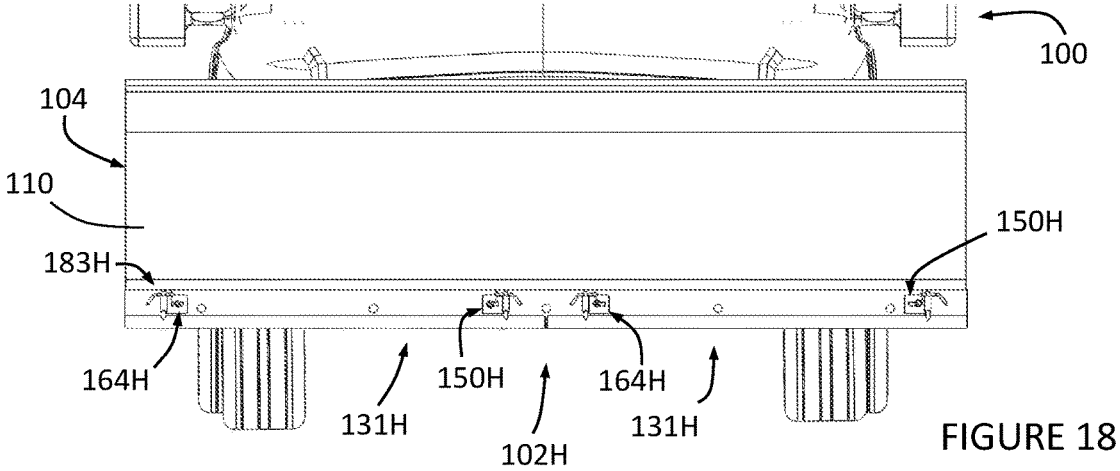
FIG. 18 depicts a front view of a two half length snow plow blade edge shoes fixed to a snow plow assembly using a quick release assembly.
Figure 19:
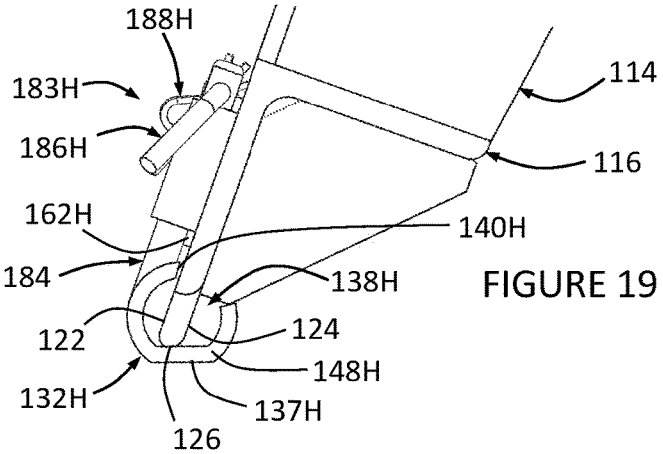
FIG. 19 depicts an end view of a snow plow blade edge shoe fixed to a snow plow assembly using a quick release assembly.
Figure 20:
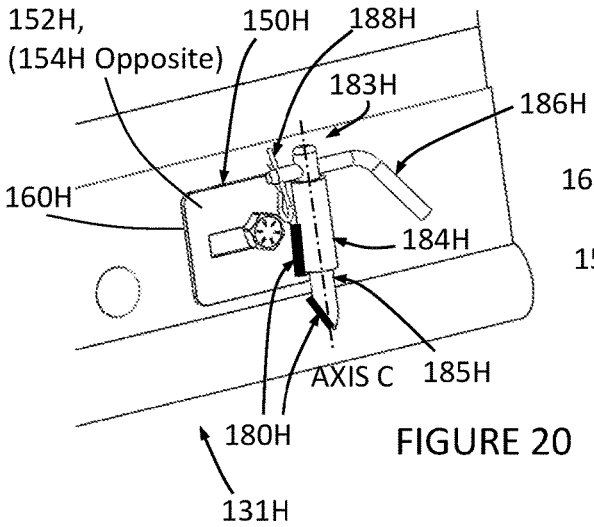
FIG. 20 depicts a partial top perspective view of a snow plow blade edge shoe fixed to a snow plow assembly using a quick release assembly.
Figure 21:
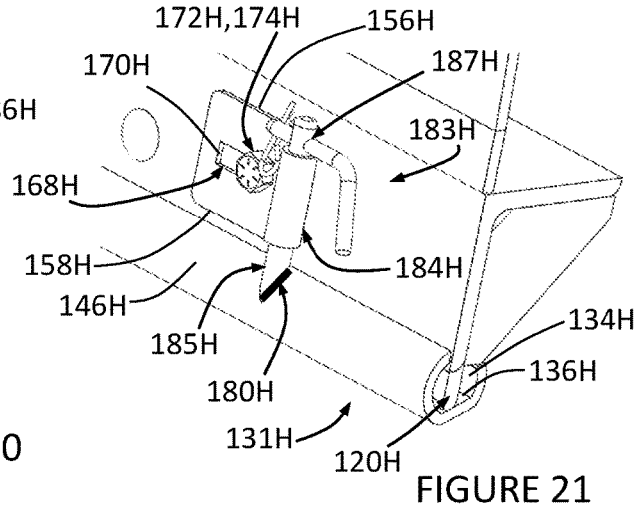
FIG. 21 depicts a partial top perspective view of a snow plow blade edge shoe fixed to a snow plow assembly using a quick release assembly.
Figure 22:
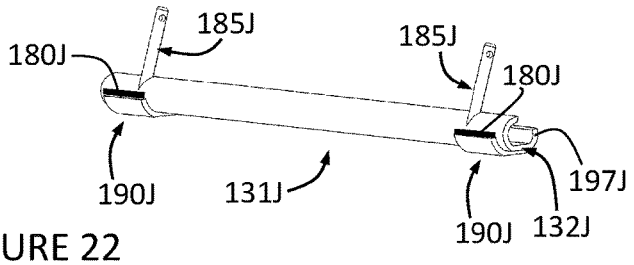
FIG. 22 depicts a top perspective view of a snow plow blade edge shoe with short wear plates.
Figure 25:
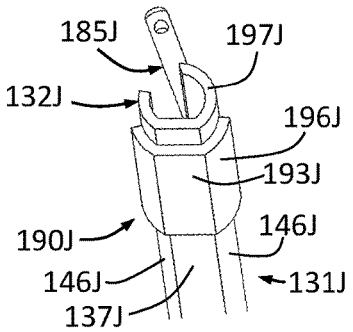
FIG. 25 depicts a partial bottom perspective view of a snow plow blade edge shoe with wear plate.
Figure 23:
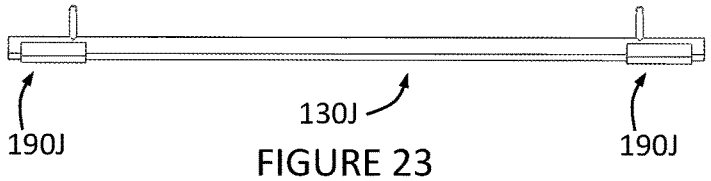
FIG. 23 depicts a bottom view of a snow plow blade edge shoe with short wear plates.
Figure 24:
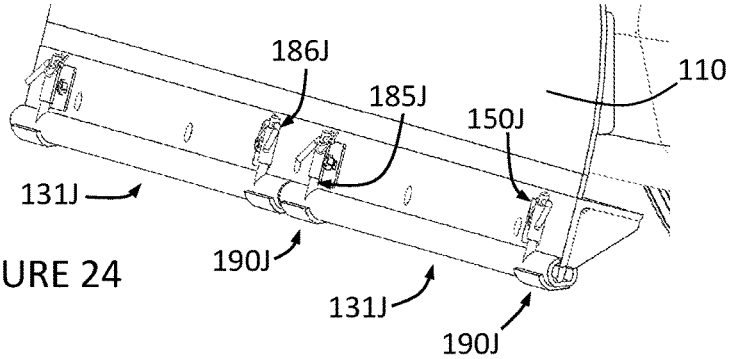
FIG. 24 depicts a top perspective view of a snow plow blade edge shoe with short wear plates mounted to a snow plow assembly.
Figure 26:
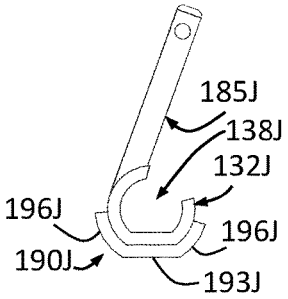
FIG. 26 depicts an end view of a snow plow blade edge shoe with wear plate.
Figure 27:
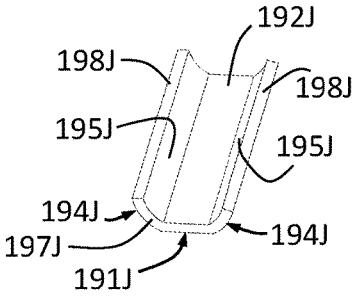
FIG. 27 depicts a top perspective view of a wear plate.

As noted in the Figures, full length or half-length snowplow blade edge shoes (130A, 131B) are a snowplow accessory configured for attachment to a snowplow assembly. A full length snowplow blade edge shoe 130A is for use on a full-length plow, whereas, a half-length snowplow blade edge shoe 131B is for use on a half-length plow. In either case, these snowplow blade edge shoes comprise an elongate flattened C-channel (132A, 132B) profile as noted in FIGS. 5-9. In some embodiments, a full-length plow, such as depicted in FIG. 18, can be fitted with two half-length snowplow blade edge shoes 131H fixed adjacent to each other.

The elongate flattened C-channels 132A, 132B whether full length or half-length, have several common features. For example in FIG. 5-7, a curved inner face 134A defines an elongate inside of the flattened C-channel along with an inner flat 136A defining an elongate flat portion of the inside of the flattened C-channel 132A. Together, the inner face and inner flat define a blade cavity 133A. In addition, the flattened C-channel has an outer face 146A defining an elongate curved portion of the outside of the C-channel. Also on the outside, the flattened C-channel has an outer flat 137A defining an elongate flat portion of the outside of the C-channel. As noted, the inner flat and outer flat are aligned on opposite sides of the C-channels interior and exterior. The elongate flat portion extends from end faces 148A at opposing ends of the C-channel. The end faces 148A join the inner face 134A and inner flat 136A, to the outer face 146A and outer flat 137A.

Figure 5:
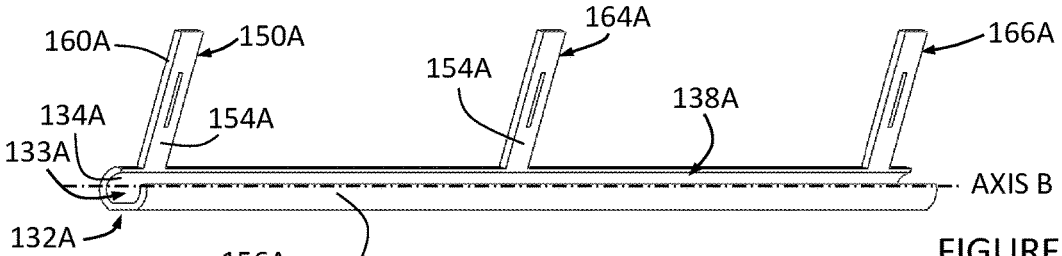
FIG. 5 depicts a rear perspective view of a snow plow blade edge shoe.

Further depicted in FIG. 5, the flattened C-channel 132A comprises a channel window 138A that serves as an elongate opening into the flattened C-channel and extends between the opposing end faces 148A. The channel window is defined by a first window face 140A and an opposed second window face 142A. Each window face extends between outer face 146A and inner face 134A.

Figure 6:
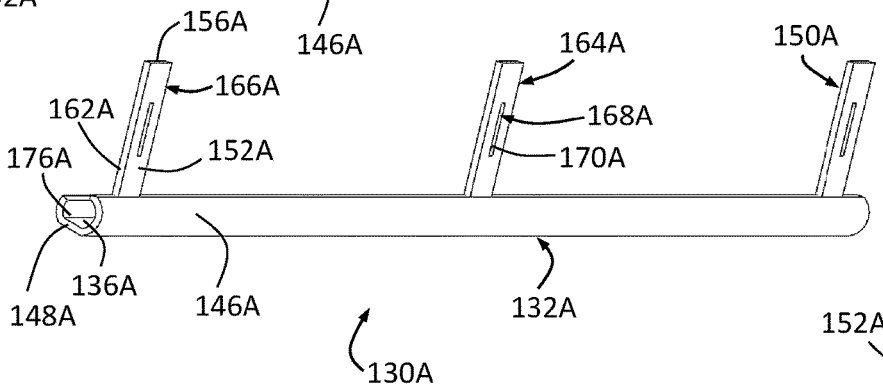
FIG. 6 depicts a front perspective view of a snow plow blade edge shoe.
Figure 7:
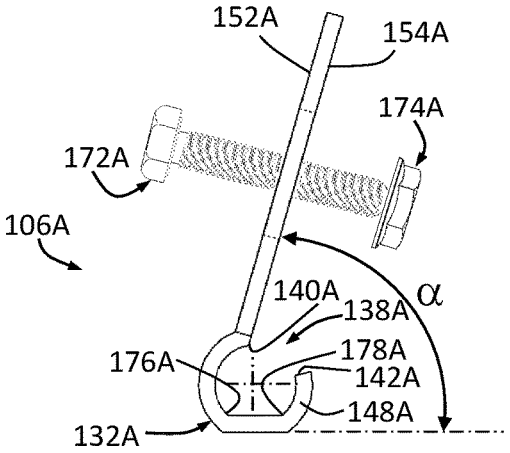
FIG. 7 depicts an end view of a snow plow blade edge shoe.
Figure 8:
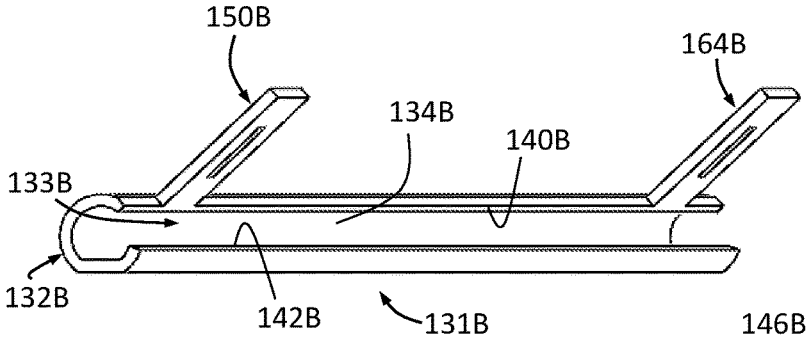
FIG. 8 depicts a rear perspective view of a snow plow blade edge shoe.

Further noted in FIG. 5-7, extending from the flattened C-channel 132A is a plurality of tabs for fixing the (full length) snowplow blade edge shoe 130A to a snowplow assembly 102A. Here, the plurality of tabs comprises a first tab 150A, a second tab 164A, and in some embodiments a third tab 166A or n-th tab. The various tabs have in an operable mode, a forward face 152A facing forward, a rearward face 154A facing rearward, a superior face 156A facing superior, a first lateral face 160A facing laterally, a second lateral face 162A facing laterally in the opposite direction, and in some embodiments an inferior face 158A facing inferiorly.

A fixation window 168A extends between the forward face 152A and the rearward face 154A in the tab yet is inset from the superior face 156A, lateral faces and inferior face (if present). The fixation window 168A in some embodiments is in the form of an elongate slot with its long dimension extending superior to inferior when in the operable mode. The slots corners can be rounded or squared. A window surface 170A extending between the forward faces 152A and rearwards faces 154A of the tabs defines the fixation window. The long dimension of the slot provides for the snowplow blade edge shoe to be adjusted to assure the cutting edge has a best fit within the C-channel regardless of cutting edge wear. The fixation window 168A has a narrow diameter sufficient to pass the shank of the fixation fastener 172A. During use, the fixation fastener 172A is extended through the fixation window 168A and mount holes 128 and secured with a fixation nut 174A to secure the snowplow blade edge shoe to the snowplow assembly 102A.

As depicted in FIG. 7, the flattened C-channel comprises a first bend line 176A and a second bend line 178A which define the transition between the flat and curved sections of the flattened C-channel.

Figure 10:
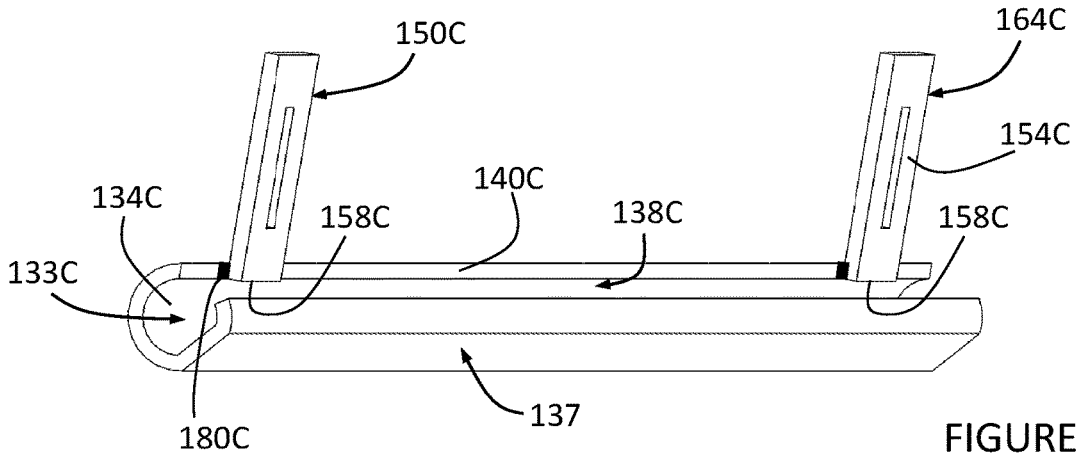
FIG. 10 depicts a bottom perspective view of the flattened C-channel of a snow plow blade edge shoe.
Figure 11:
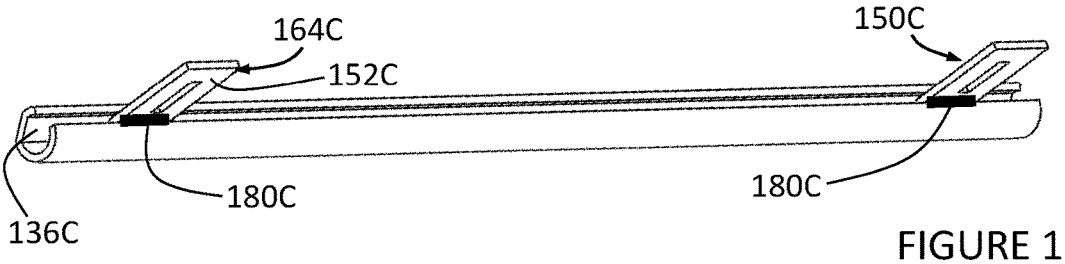
FIG. 11 depicts a top view perspective view of a snow plow blade edge shoe.
Figure 12:
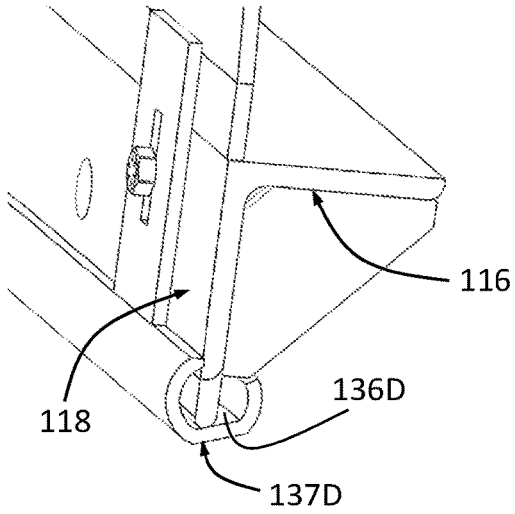
FIG. 12 depicts an end perspective view of a snow plow blade edge shoe mounted on a snow plow assembly.
Figure 13:
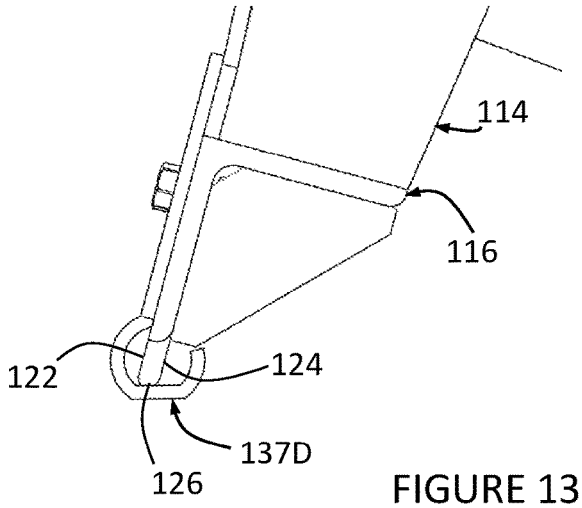
FIG. 13 depicts an end view of a snow plow blade edge shoe mounted on a snow plow assembly.
Figure 17:
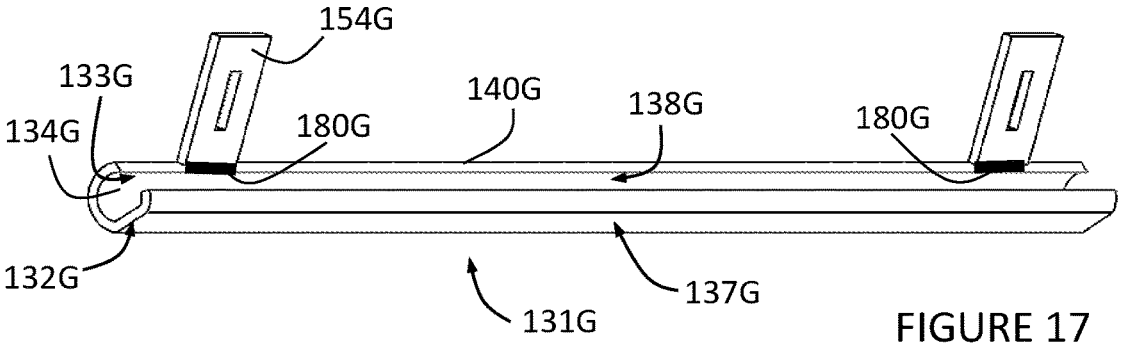
FIG. 17 depicts a rear view of a snow plow blade edge show with weld.

The tabs (first tab 150A, second tab 164A, third tab 166A) are fixed to or extend from the flattened C-channel 132A. For example, the full-length snowplow blade edge shoe 130A of FIG. 6 comprises tabs that are contiguous extensions formed from the same sheet metal sheet of the flattened C-channel 132A. In other embodiments, such as illustrated in FIG. 10-11, welds 180C are utilized to secure the tabs 150C and 164C to the flattened C-channel. In this embodiment, the forward face 152C is positioned abutting the first window face 140C in the channel window 138C and welded 180C at their junction. In other embodiments, the inferior face 158F of a tab is placed against an outer face 146F of the flattened C-channel 132F adjacent to the first window face 140F of the flattened C-channel and welded 180F into place. The weld can be for example, one or the other or both of: between the forward face 152F and the outer face 146F, or between the inferior face 158F and first window face 140F. Alternatively, as illustrated in FIG. 17, the weld 180G, can be between the rearward face 154G and first window face 140G or inner face 134G.

Figure 16:
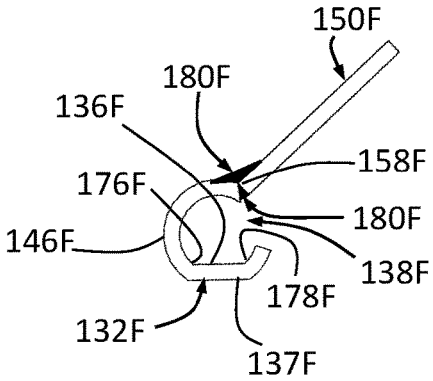
FIG. 16 depicts an end view of a snow plow blade edge shoe with weld.

Common snowplow cutting edges 120 comprises a lead cut face 122 which faces forward, a posterior cut face 124 facing rearward, and an inferior cut face 126 facing downward. As noted in FIGS. 12-15, in a operable mode, a portion of the cutting edge 120 of a snowplow assembly 102 extends through the channel window and is seated in the C-channel. For example, depicted in FIG. 16, cutting edge 120 extends through channel window 138F and is seated within the inside of elongate flattened C-channel 132F of the of the snowplow blade edge shoe.

Figure 9:
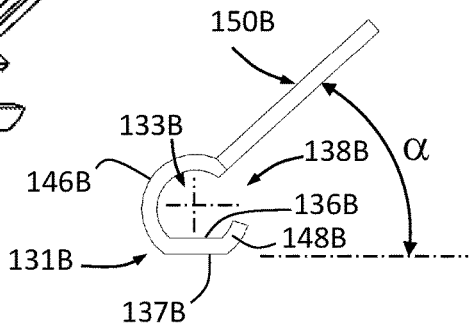
FIG. 9 depicts an end view of a snow plow blade edge shoe with angulation of the tab.

As depicted in FIG. 7 and FIG. 9, the angular orientation of the tabs in relation to the outer flat can vary according to differing plow designs. This angular relationship is labeled as angle α. Typically, the rearward faces of the tabs are aligned in a single plane. In some embodiments, this α angle is customized in response to the variable slope of the face of the blade's lead face 110 or other structure (such as a base angle 116) to which the tabs are secured. With the plow shoe positioned over the cutting edge and fixed to the snow plow assembly and with the snowplow assembly lowered to the ground, angle α is adjusted such that the outer flat is generally parallel to the ground. Therefore, during plowing over rough surfaces, the outer flat with its broad surface will provide a longer wear life. In most cases angle α will range between 85 degrees and 40 degrees.

As depicted in FIG. 18, a full-length plow, can be fitted with two half-length snowplow blade edge shoes 131H fixed adjacent to each other as opposed to the full-length shoe depicted in FIG. 2. The half-length and full-length snowplow blade edge shoes can be secured to the snowplow assembly by using fasteners as depicted in FIGS. 12-15, however, in alternative embodiments, a quick release assembly 183H can be utilized. One example of a quick release assembly for a snowplow blade edge shoe is depicted in FIGS. 18-21. In this embodiment, a half-length snowplow blade edge shoe 131H in an operable mode comprises a lock post 185H extending upward from an outer face 146H of flattened C-channel 132H adjacent to first window face 140H. In this embodiment, the lock post is in the form of a round bar, however, it can assume other profiles. Near a terminal end of the lock post 185H is block pin receiver 187H for receiving a block pin 186H. Here the block pin receiver is in the form of an extended hole sized for sliding fit of the block pin through the block pin. A safety pin 188H, depicted here in the form of a cotter pin, is utilized to capture a groove or hole at the end of the block pin to prevent unintended removal. Like previous embodiments, this embodiment comprises a plurality of tabs (i.e. first tab 150H, second tab, third tab, etc.) for fixing to the lead face of a snow plow blade or cutting edge. First tab 150H comprises tab features previously presented such as forward face 152H, and rearward face 154H, and a fixation window 168H through which fixation fasteners 172H and fixation nuts 174 are used. Secured to the forward face 152H of the tabs is a receiver tube 184H having an interior configured for receiving lock post 185H therein. The receiver tube 184H in this embodiment is secured using a weld 180H to forward face 152H.

A method of using the FIG. 18 snowplow blade edge shoe(s) 131H comprises the following steps. Securing the tab member (first tab 150H, second tab 164H) to the lead face of the snowplow or cutting edge using the fixation fastener 172H and fixation nut 174H though the corresponding mount holes 128 making sure the central axis of the receiver tube 184H is generally perpendicular to the flattened C-channel 132H. Spacing the receiver tubes to match the spacing of the respective lock posts 185H before final tightening of the fixation fasteners. Lifting the snowplow blade edge shoe upwards such that the cutting edge 120H enters the channel window 138H and is seated in the C-channel while simultaneously aligning and gliding the lock posts 185H into the respective receiver tubes 184H. When the C-channel is fully seated against the cutting edge, the block pins 186H associated with each lock post 185H, are inserted into the respective block pin receivers 187H, and are secured in place with safety pin 188H. Removing the snowplow blade edge shoe requires only removal of the safety pins, removal of the block pins, and lowering of the flattened C-channel 132H from the snowplow.

Figure 28:
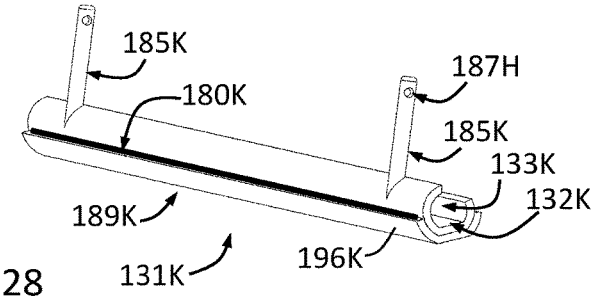
FIG. 28 depicts a top perspective view of a snow plow blade edge shoe with full length wear plate.
Figure 29:
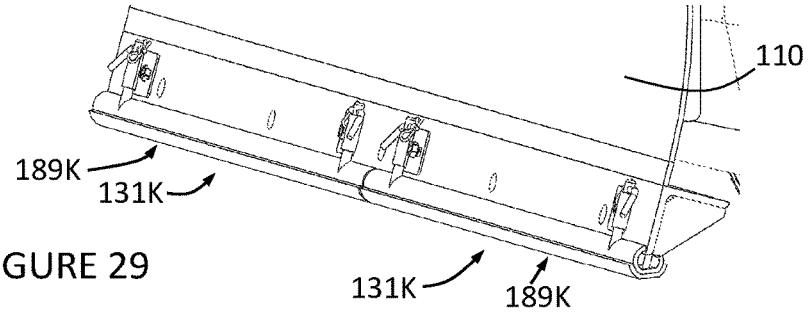
FIG. 29 depicts a top perspective view of two half length snow plow blade edge shoes mounted on a full length snow plow assembly.

In some embodiments, the full length snowplow blade edge shoe and half length snow plow blade edge shoe comprise a full length wear plate or a pair of short wear plates fixed to an outer surface of the snow plow blade edge shoe to provide additional wear capacity. The full length wear plate will be substantially the length of the respective snow plow blade edge shoe, whereas the short wear plate will be approximately 3 inches to 10 inches in length. For example, as depicted in FIGS. 22-27, at least a portion of the outer flat 137J and the outer face 146J of a flattened C-channel 132J is covered with a short wear plate 190J covering just the opposed end portions of the flattened C-channel 132J. A full length wear plate 189K (FIG. 28-29) covers substantially the entire length of the flattened C-channel 132K. As depicted in the FIG. 22 embodiment, the short wear plates 190J are fixed by the use of welds 180J to the flattened C-channel 132J near or at terminal faces 197J of flattened C-channel 132J. The welds can be at the junction of any one or more of terminal face 197J and upper face 198J, with adjacent outer flat 137J and/or outer face 146J.

Both the full length wear plate 189K and the short wear plate 190J comprise a profile to fit the outer contour of the respective flattened C-channel. This comprises a flat wall 191J (191K for full length) with an interior flat face 192J on one side of the flat wall to complement the outer flat of the C-channel, and an opposing exterior flat face 193J on the exterior of the wear plate. Extending from each side of the wear plate's flat wall is a curved ascending wall 194J to complement the contour of the outer face 146J of the flattened C-channel 132J. Here, an interior ascending face 195J on the ascending wall abuts the outer face 146J of the C-channel, whereas, an opposing exterior ascending face 196J faces outward. Again, the full length wear plate 189 comprises the same surfaces as the short wear plate but are designated with the 'K' instead of 'J'. The wear plates provide an extra layer of wear protection to the snow plow blade edge shoes adding significant life against abrasion. The layered construction approach eases the challenges of bending thicker metals during manufacturing.

In preferred embodiments, the full length and half length snowplow blade edge shoes and the full length wear plate and short wear plate are manufactured from AR-200 steel plate, however other metals can be used. After welding, the devices are preferably powder coated for corrosion protection.

It is noted that the terms "substantially" and "about" and "generally" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

The foregoing invention has been described in accordance with the relevant legal standards, thus the description is exemplary rather than limiting in nature. Variations and modifications to the disclosed embodiment may become apparent to those skilled in the art and fall within the scope of the invention.

The invention claimed is:

1. A snow plow blade edge shoe comprising:

an elongate flattened C-channel;

said elongate flattened C-channel having a curved inner face on the flattened C-channel facing the inside of said flattened C-channel;

said inner face partially defining a blade cavity for seating a snow plow blade therein;

said elongate flattened C-channel having an outer face on the flattened C-channel facing outward from said flattened C-channel;

a first window face extending from said inner face to said outer face;

a second window face extending from said inner face to said outer face;

said first window face and said second window face spaced from each other to define a channel window for access into said blade cavity;

said flattened C-channel comprising an outer flat defining a flattened aspect of said flattened C-channel;

said flattened C-channel comprising an inner flat defining a flattened aspect of said flattened C-channel in said blade cavity; and, wherein said outer flat is angled at an acute angle $\alpha$ with respect to said first window face such that said outer flat is positioned horizontal during snow plowing operations.

2. The snow plow blade edge shoe of claim 1 further comprising:

a first tab;

said first tab extending from said flattened C-channel at one side of said channel window wherein said first tab is operable for securing to a snow plow blade;

a second tab;

said second tab spaced from said first tab extending from said flattened C-channel on the same side of said channel window operable for securing to said snow plow blade.

3. The snow plow blade edge shoe of claim 2 wherein said tab is angled from said outer flat at an angle between 40-85 degrees.

4. The snow plow blade edge shoe of claim 2 wherein said first tab and said second tab are welded to said flattened C-channel.

5. The snow plow blade edge show of claim 2 wherein said first tab and said second tab are integrated with said flattened C-channel to form a single part.

6. The snow plow blade edge shoe of claim 2 wherein a portion of one or both of said first tab and said second tab are positioned against one of said first window face and said second window face.

7. The snow plow blade edge shoe of claim 2 wherein said first tab and said second tab comprise a fixation window in the form of a slot extending through the tab for fixation to a plow using fasteners.

8. The snow plow blade edge shoe of claim 1 wherein said elongate flattened C-channel of said snow plow blade edge shoe is manufactured from AR-200 steel.

9. The snow plow blade edge shoe of claim 1 wherein said elongate flattened C-channel is the length of a full length snow plow blade.

10. The snow plow blade edge shoe of claim 1 wherein said elongate flattened C-channel is half the length of a full length snow plow blade.

11. The snow plow blade edge shoe of claim 1 further comprising:

a first tab;

a second tab;

said first tab and said second tab having a forward face on one side of the respective tab;

a lock post;

said lock post positioned perpendicular to said elongate flattened C-channel and fixed to said outer face;

a receiver tube;

said receiver tube secured to said forward face; and, wherein said lock post is housed in said receiver tube.

12. The snow plow blade edge shoe of claim 11 further comprising:

said lock post comprising a block pin receiver in the form of a through hole at one end of said lock post.

13. The snow plow blade edge shoe of claim 12 further comprising:

a block pin;

said block pin extending through said block pin receiver;

a safety pin;

said safety pin releasably restraining said block pin in said block pin receiver for quick release removal of said snow plow blade edge shoe.

14. The snow plow blade edge shoe of claim 1 further comprising:

a wear plate;

said wear plate comprising a flat wall;

said wear plate comprising an ascending wall;

said ascending wall extending from two sides of said flat wall to contour about said outer flat and said outer face of said flattened C-channel;

wherein said wear plate is fixed to said flattened C-channel.

15. A snow plow with snow plow blade edge shoe comprising:

a snow plow assembly;

said snow plow assembly comprising a snow plow blade;

a cutting edge;

said cutting edge in the form of a flat elongate steel bar;

said cutting edge fastened to said snow plow blade at the bottom of a lead face of the snow plow blade;

a snow plow blade edge shoe;

said snow plow blade edge shoe comprising an elongate flattened C-channel;

said elongate flattened C-channel comprising an elongate outer flat extending along said flattened C-channel;

said snow plow blade edge shoe comprising a blade cavity for housing a portion of said cutting edge therein;

said blade cavity defined by an inner flat on the inside of said flattened C-channel;

said blade cavity defined by a concave inner face extending upward from said inner flat;

a first bend line located at the junction of said inner flat and said inner face;

said flattened C-channel comprising a channel window providing access for said cutting edge to be seated in said blade cavity;

said cutting edge seated in said blade cavity;

said cutting edge positioned adjacent said first bend line;

said snow plow blade edge shoe secured to said snow plow blade; and, wherein said outer flat is parallel to the ground when said snow plow assembly is lowered.

16. The snow plow with snow plow blade edge shoe of claim 15 further comprising:

a quick release assembly;

said quick release assembly comprising a lock post extending perpendicular to said flattened C-channel;

said lock post fixed to and extending from said outer face of said flattened C-channel;

a block pin;

said block pin extending through said lock post to secure said snow plow blade edge shoe to said snow plow assembly.

17. The snow plow with snow plow blade edge shoe of claim 15 further comprising:

a wear plate;

said wear plate covering at least a portion of said outer flat; and, said wear plate fixed to said flattened C-channel.

18. The snow plow with snow plow blade edge shoe of claim 17 wherein a said wear plate is secured to each end of said flattened C-channel.

19. The snow plow with snow plow blade edge shoe of claim 15 further comprising:

said snow plow assembly comprising a left blade and a right blade;

said snow plow blade edge shoe is a half length snow plow blade edge shoe; and, wherein one said half length snow plow blade edge shoe is coupled to said left blade and said right blade.

20. The snow plow with snow plow blade edge shoe of claim 15 further comprising:

said snow plow assembly comprising a single full blade;

said snow plow blade edge shoe is a full length snow plow blade edge shoe; and, wherein said full length snow plow blade edge shoe is coupled to said single full blade.

* * * * *